US006260335B1

(12) United States Patent
Helinski

(10) Patent No.: US 6,260,335 B1
(45) Date of Patent: Jul. 17, 2001

(54) CHRISTMAS TREE CART

(76) Inventor: Edward Frank Helinski, 1502 Oakdale Rd., Johnson City, NY (US) 13790

( * ) Notice: Subject to any disclaimer, the term of this patent is extended or adjusted under 35 U.S.C. 154(b) by 0 days.

(21) Appl. No.: 09/437,377

(22) Filed: Nov. 10, 1999

(51) Int. Cl.[7] ..... B65B 13/20

(52) U.S. Cl. ..... 53/530; 53/390; 53/588; 100/13

(58) Field of Search ..... 100/13, 144; 53/255, 53/390, 530, 588

(56) References Cited

U.S. PATENT DOCUMENTS

| | | | | |
|---|---|---|---|---|
| D. 400,333 | | 10/1998 | Westlake . | |
| 2,720,055 | * | 10/1955 | Morris | 53/530 X |
| 2,792,775 | * | 5/1957 | Beyette | 100/13 X |
| 2,856,845 | * | 10/1958 | Beyette | 100/13 X |
| 2,966,111 | * | 12/1960 | Yafjack | 100/13 X |
| 2,974,457 | * | 5/1961 | Saxton | 53/530 X |
| 3,135,191 | * | 6/1964 | Skinner | 53/530 X |
| 3,380,220 | * | 4/1968 | Jennings et al. | 53/530 X |
| 3,416,434 | * | 12/1968 | Woserau et al. | 53/530 X |
| 3,440,954 | * | 4/1969 | Woserau et al. | 53/530 X |
| 3,473,291 | * | 10/1969 | Raymond et al. | 53/530 |
| 3,548,567 | * | 12/1970 | Manetta | 53/530 |
| 4,619,193 | | 10/1986 | Crew . | |
| 4,759,169 | * | 7/1988 | Schneiders | 53/530 |
| 4,796,413 | * | 1/1989 | Howe | 53/530 |
| 5,070,678 | | 12/1991 | Morrill . | |
| 5,421,140 | | 6/1995 | Theriault . | |

* cited by examiner

*Primary Examiner*—John Sipos

(57) ABSTRACT

A Christmas tree cart comprised of a hollow cylindrical tree holder mounted on wheels or a skid and having a handle and mechanical device to pull the tree into the cylinder to compress the tree limbs and carry the tree and upon removal of the tree from the cylinder the tree is baled with twine or netting using an integral baler.

9 Claims, 3 Drawing Sheets

CHRISTMAS TREE CART

FIELD OF THE INVENTION

The present invention relates to a lightweight and compact Christmas tree cart primarily for use by choose-and-cut shoppers in the retail Christmas tree industry. This invention is useful in compacting the size of a cut tree allowing it to be transported through narrow spaces between standing trees in a Christmas tree plantation. The cut tree is kept clean while being transported because it is not in contact with the ground and the effort is reduced compared to carrying or dragging the tree. The tree is baled using an integral baling device while the tree is removed from the cart near the point of sale or transport.

BACKGROUND OF THE INVENTION

Retail Christmas tree sales are generally divided into sales of individual cut or baled trees which are usually sold at a retail lot or by choose-and-cut trees, which are fresh trees cut by the customer at the Christmas tree farm. When a customer chooses and cuts a tree, the tree is usually carried or dragged by the customer out of the stand of trees to the point of sale where it can be baled to compact and secure the boughs of the tree toward its main stem using twine or netting making the tree more easily handled and reducing the possibility of damage to the boughs. The transporting of a tree at the tree farm is sometimes done as a service by the seller using a large wagon pulled by a tractor which is restricted to wide lanes of travel. The baling operation is also a service often performed by the seller using mechanical equipment which performs the netting or spiral twining of the tree. The equipment used for bailing is generally heavy, large and substantially stationary and usually requires a trained operator. The present invention makes shopping for a choose-and-cut tree a cleaner, easier and more pleasant experience by providing a light weight and easily handled for the customers use in much the same way as a grocery cart facilitates the grocery shopping experience.

The customer would take the cart into the stand of trees and, after choosing and cutting a tree, would place it into the cart where it would be compressed, secured and supported for transport within the lightweight, large, wheeled, smooth rolling cart which would be hand pulled by the customer out of the stand of trees to the point of sale and in some cases to the customer's vehicle.

The baling of the tree coincident with its removal from the cart can be done by the customer with some assistance, if necessary, from the tree grower or checkout person. When the tree is baled it is more easily handled and loaded into or on the customers vehicle for transport. The time and effort of the tree farm's staff is reduced due to the customers involvement and results in greater efficiency and reduced operating cost.

The need for providing tree transport services using tractors and wagons would be reduced or eliminated. The need for expensive and stationary baling equipment would also be reduced or estimated.

Apparatus for compressing and packaging trees are known in the art. One such mechanism is disclosed in U.S. Pat. No. 5,421,140, issued to Ralph Theriault on Jun. 6, 1995. The mechanism disclosed is large, heavy and intended for stationary use in large scale harvesting and shipping operations and provides a gasoline engine which powers a hydraulic drive with controls which enable pulling a tree through a funnel loader having a supply of netting to bind or bale the tree exiting the funnel loader. The entire mechanism is mounted on wheels and is equipped with a hitch for being pulled using a tractor, truck or car and is too large and too heavy to be pulled by hand and does not have a handle for purposes for pulling or carrying and no means is thought for making the invention suitable for transporting a Christmas tree by hand.

Apparatus for transporting trees are also known to the art. U.S. Pat. No. Des. Christmas 400,333, issued to Gary Westlake on Oct. 27, 1998, describes a Christmas Tree Transport Cart which is a wagon like cart having four wheels and a substantially u-shape bed to support the Christmas tree and has a handle provided for pulling. The cart does not describe any means to compact the tree or to secure the tree in a compacted state and does not have a means of binding or baling the tree. In addition, the cart is large and as long as the tree and wider than a baled tree and has a large turning radius making it difficult to maneuver within a stand of trees.

Apparatus for moving and bagging Christmas trees is also known to the art. U.S. Pat. No. 5,070,678, issued to Paul M. Morrill on Dec. 12, 1991, describes a moving and bagging cart having a means of securing a Christmas tree having a handle to carry the cart and wheels for transport. The wheels are small and unsuitable for use in transporting a cut tree from a stand of trees. There are no means described for compressing the tree, for securing the tree in a compressed state and for baling or binding the tree in compressed form.

Apparatus for the spiral twining of trees are also known in the art. One such mechanism is disclosed in U.S. Pat. No. 4,619,193, issued to Gerald W. Crew on Oct. 28, 1986. Tree baling is done using the spiral twining method using twine to wrap the tree. A rotating hoop is used along with a twine canister and a means of tensioning twine. There is no method taught to secure, support or suspend the tree for transport and no handle is provided for that purpose.

SUMMARY OF THE INVENTION

Aspects of the present invention provide an open ended enclosure or housing into which the base of the Christmas tree is pulled either manually or by a mechanically advantaged device connected to the tree using a cable or rope, which reduces the force and effort required by the operator to pull the tree into the enclosure. As the tree is pulled base first into the opening of the enclosure its boughs are compressed inwardly toward the main stem of the tree and held by the enclosure in a compacted position ready to be transported by pulling using the lightweight cart having wheels or a skid and having an attached handle provided for manual pulling. Upon removal of the tree, which is done by continuing to pull the base of the tree in the same direction out of the enclosure through a second opening the tree can be baled either by the use of a netting device located near the second opening or by using a spiral twining device attached near the second opening.

BRIEF DESCRIPTION OF THE DRAWINGS

It will be more clearly understood when considered in conjunction with the accompanying drawings, in which.

DETAILED DESCRIPTION OF THE INVENTION

For a better understanding of the present invention, together with other and further objects, advantages and capabilities thereof, reference is made to the following disclosure and appended claims in connection with the above-described drawings. It is understood that like numerals may be used to indicate like elements from Figure to Figure.

As discussed above, the present invention relates to a lightweight Christmas tree cart which is particularly useful for compacting the size of a Christmas tree as well as supporting, securing and carrying it in a compacted state usually to the point of sale or transport. During the process of removing the tree from the cart the tree is optionally baled.

Figure 1:
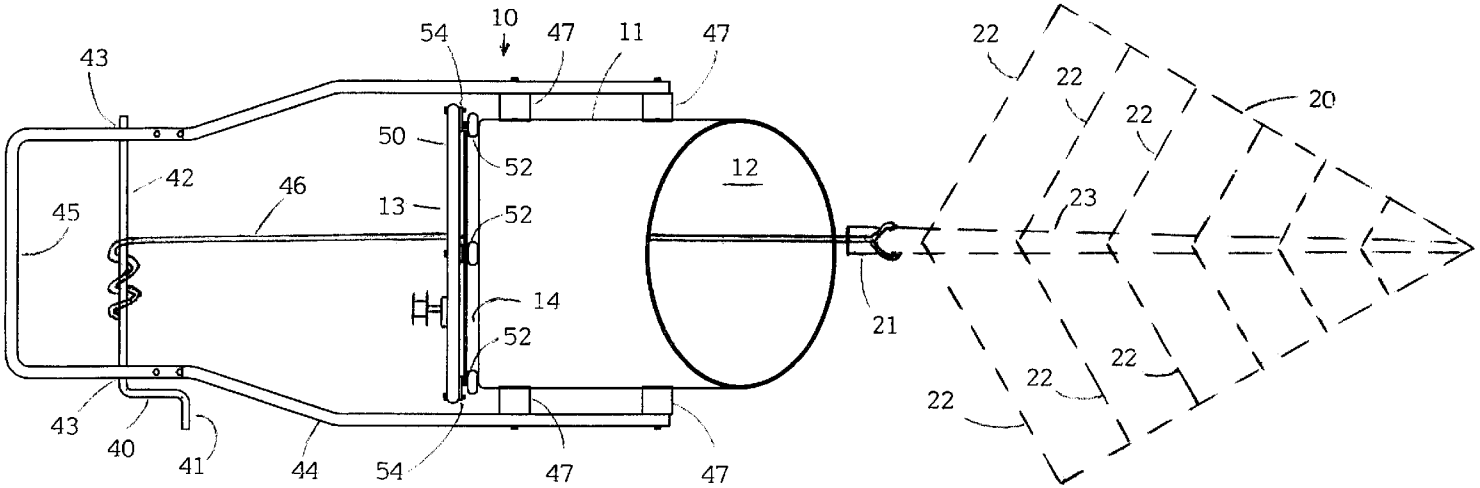
FIG. 1 represents a plan view of the Christmas tree cart assembly with a Christmas tree positioned for placement into the cart.

FIG. 1 illustrates a compact and light weight cart assembly which enables the compacting, supporting, securing, suspending, transporting and baling of a Christmas tree. The Christmas tree cart assembly is only a fraction of the size of a tree which it carries. For example, an eight foot tall Christmas tree having boughs which extend 3 feet on each side of the main stem of the tree, approximately 6 foot effective diameter, can be carried in a cart having a enclosure housing which is approximately 2.5 feet long and 2 feet in diameter.

The act of compacting the tree within the carts enclosed housing inherently secures the tree and its boughs in place by retaining the boughs in a compacted state within the enclosure making it ready for carrying and therefore does not require any additional means of securing. The use of a cart having a compacting feature makes it possible to reduce the size and weight of the cart and leads to its easy handling and maneuverability.

Figure 2:
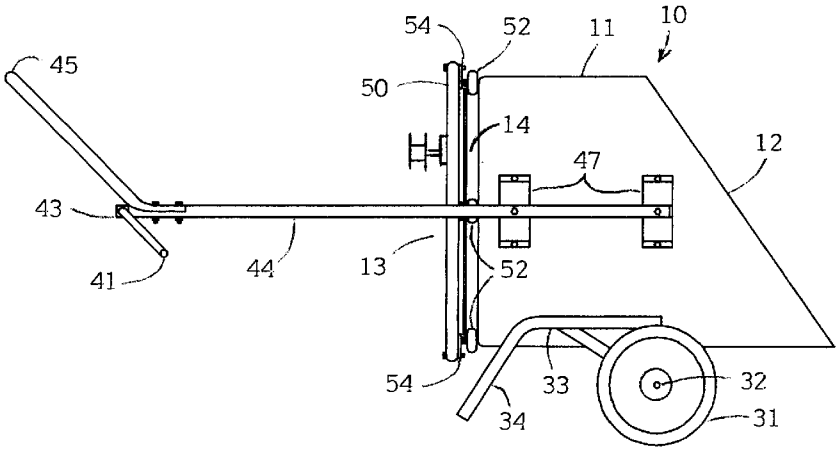
FIG. 2 represents a side elevation view of the Christmas tree cart assembly described in FIG. 1.

The Christmas tree cart assembly of FIGS. 1 and 2 has a tree compaction assembly 10 where tree compaction is facilitated by using a hand cranking mechanism 40 having a crank handle 41 connected to a crank shaft 42 which is supported by bearings 43 mounted partially within framing members 44 which also connect to handle 45 on one end, then leading and connecting to enclosure 11 on the opposite end. Crankshaft 42 has an attached cable or rope 46 which passes through a first opening 12 and a second opening 13 of hollow cylindrical enclosure 11 and may have a commercially available s-hook attached, which is not shown.

Crank handle 41 and crank shaft 42 are preferably formed using one piece of round, preferably stainless steel, rod. Rope 46 may be commercially available nylon or polypropylene rope or any material suitable for use as a flexible elongated tensile member.

When crank handle 41, as shown in FIG. 1, is turned manually rope 46 is wound around crank shaft 42 causing the extended portion of rope 46, which may be attached around tree 20 near the base of trunk 21, to be moved toward crank shaft 42. Continued rotation of crank handle 41 results in the trunk 21 of tree 20 being pulled into a first opening 12 at the input of cylindrical enclosure 11 and upon continued rotation of crank handle 41 trunk 21 passes through second, output or exit opening 13 resulting in tree 20 being compacted by the forces acting to bend the boughs 22 of the tree 20 toward the main stem 23 of tree 20 when the smooth rounded edge of first opening 12 acts on boughs 22. First opening 12 may be constructed with a more rounded edge than described in the figures and may have a separately attached or integrally formed cone shaped or rounded sections which form first opening 12.

FIGS. 1 and 2 describe the cylindrical enclosure 11 which has a substantially vertically disposed second opening 13, which is perpendicular to its central axis, and a first opening 12 which is oblique to said central axis.

First opening 12 is shown having a larger perimeter opening than the interior circumference of cylindrical enclosure 11 due to the angular tilt of first opening 12 and this results in a funneling effect as tree 20 passes into opening 12 and into cylindrical enclosure 11. The benefits of the present inventions funneling effect is very much like the benefits derived from state of the art funnel loaders. This funneling effect would not occur if opening 12 were vertically disposed and had the same perimeter opening as the circumference of cylindrical enclosure 11. The described funneling effect, while not essential, reduces the force required to pull the tree 20 through opening 12 and into cylindrical enclosure 11 where its compressed boughs 22 are supported and secured in a compacted state by the walls of cylindrical enclosure 11 in position for transport.

The described hand cranking mechanism 40 significantly reduces the operators manual effort in placing a tree into the enclosure. However, the tree can be manually forced into the enclosure and compacted without the aid of any mechanical pulling mechanism when only smaller trees are inserted.

The use of a mechanically advantaged pulling mechanism such as the one described enables a larger number of retail customers to compact a wider range of tree sizes. The present invention as illustrated in FIGS. 2 and 3 is also equipped to suspend and transport a tree which is held in a compacted position as described using a pair of ground contacting wheels 31 which are supported for rotation proximate the ends of a common axle 32 located below cylindrical enclosure 11.

Figure 3:
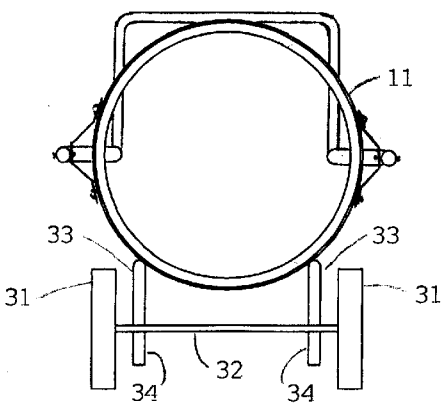
FIG. 3 represents a rear elevation view of an alternate embodiment of a Christmas tree cart assembly.

Transport framing members 33 illustrated in FIGS. 2 and 3 are preferably made of tubular welded steel construction and are welded to axle 32 and connect to enclosure 11 using bolts. Enclosure 11 is preferably made of polyethylene plastic or reinforced plastic. Downward extensions of framing members 33 form two support legs 34 for the cart assembly which are used to suspend the cart along with the two transport wheels 31 forming four points of support for when the cart is not being pulled.

Figure 6:
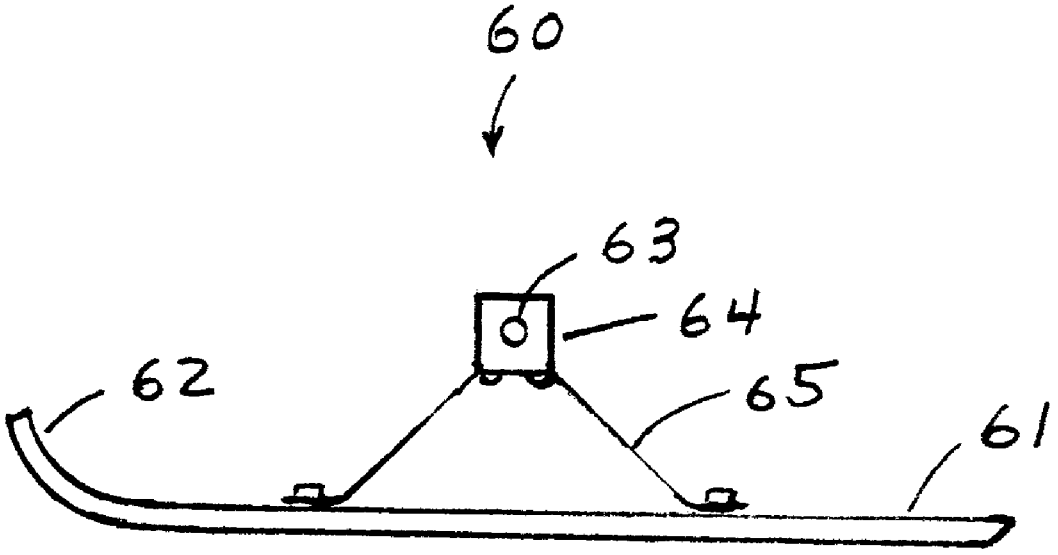
FIG. 6 represents a side elevation view of an alternate embodiment of an alternate embodiment of a transport means for use on the Christmas tree cart assembly shown FIGS. 2, 3, 4, 5.

The balance point of both the loaded and unloaded cart is between front support legs 34 and wheels 31. The tree may be adjusted to the described balance point by its positioning during the compacting process and during its placement within enclosure 11. This method of balancing the cart also assures that, when the cart is pulled, the majority of the trees weight is supported by the wheels 31 making it easy to maneuver and carry the cart using pulling handle 45. FIG. 6 describes an alternative transport means using a skid assembly 60, which mounts on axle 32, for use over snow and replaces the wheels 31 described in FIG. 2 and 3. Skid assembly 50 uses a one or two skids 61 having an upward curved tip 62 which would be mounted to point in the forward direction of travel. Two axle housings 64 having openings 63 are provided for attachment to axle 32. Axle housings 64 are attached to framing members 65 which fasten to skid 61. Skid 61 may be made using wood such as spruce, or plastic, or wood and plastic laminates. Housing 64 may be made of suitable metal or plastic materials preferably nylon. Framing members 65 may be made using sheet metal preferably aluminum.

Figure 5:
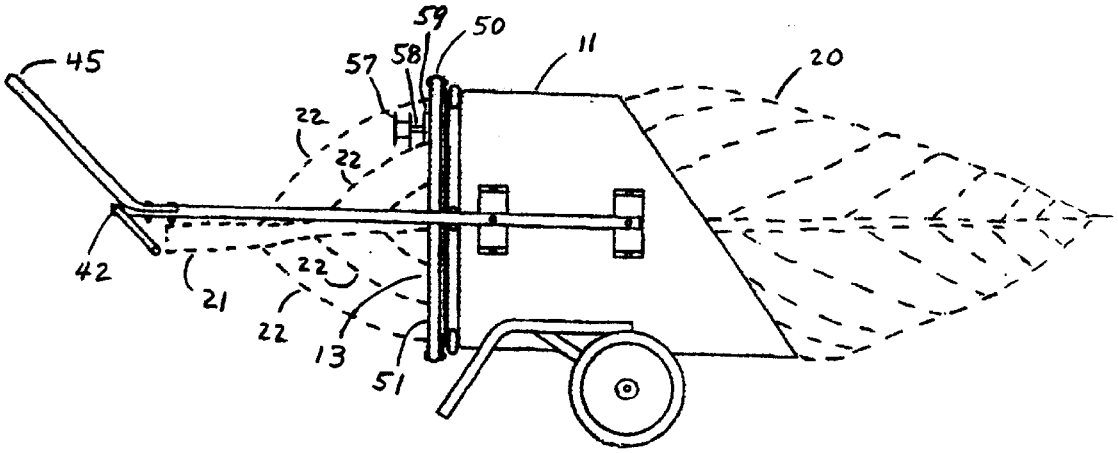
FIG. 5 represents a side elevation view of the Christmas tree cart assembly described in FIG. 2 illustrated with a Christmas tree within the cart enclosure.

In FIGS. 1 and 2 tubular pulling handle 45 is first connected to two tubular framing members 44 which also supports cranking mechanism 40 and crankshaft bearings 43 which may be made using a stepped cylindrical section preferably made of nylon or other suitable bearing material and having a transverse hole which accepts crankshaft 42 and is supported by mounting the smaller diameter cylindrical section of crankshaft bearings 43 within tubular framing members 44. Framing members 44 are connected to the sides of cylindrical enclosure 11 using four metal brackets 47 or other suitable material to space framing members 44 away from enclosure 11 and are attached using bolts providing rigid support for cranking mechanism 40 and pulling handle 45. Pulling handle 45 is used by the operator to pull the mobile cart assembly by itself or with the tree compacted, supported and held as illustrated in FIG. 5.

In a simplified embodiment of the present invention, which is not illustrated, pulling handle 45 may be removed and crankshaft 42 can be used as a handle to carry the cart. After the tree 20 is transported to its final destination tree 20 can be baled, using various restraining materials such as commercially available netting or twine, at the same time it is removed from cylindrical enclosure 11.

Figure 4:
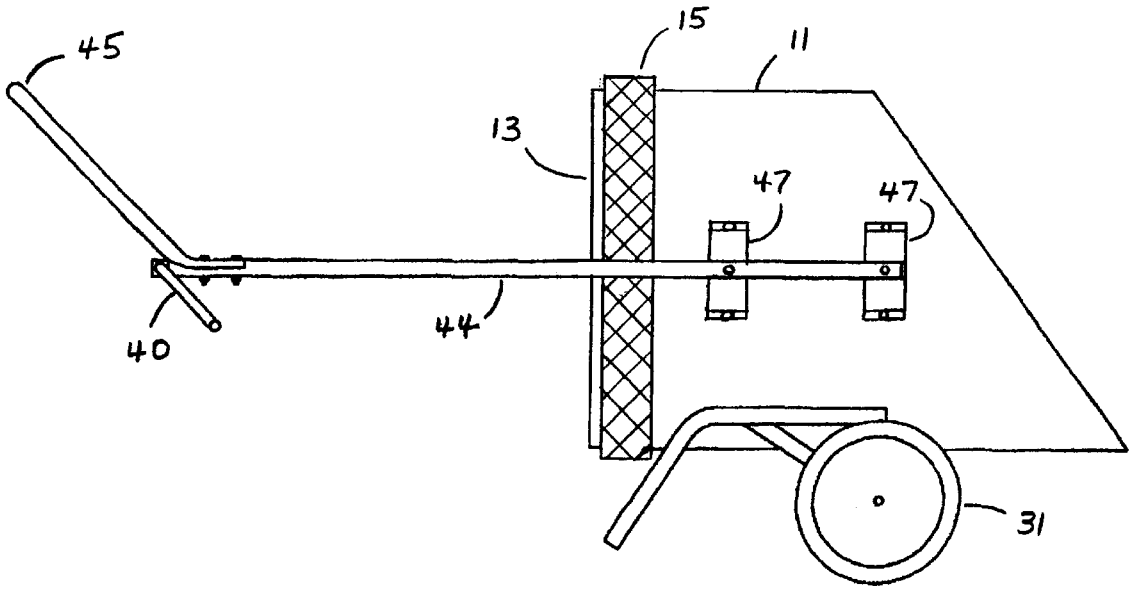
FIG. 4 represents a side elevation view of an alternate embodiment of a Christmas tree cart assembly having a netting feature.

FIG. 4 illustrates a Christmas tree cart assembly having the previously described cranking mechanism 40, pulling handle 45 and transport means including wheels 31 along with a known baling means having commercially available telescoped netting 15 which is supported around cylindrical enclosure 11 near its exit opening. Framing members 44 are spaced away from enclosure 11 using brackets 47 to provide room for netting 15. The end of the netting 15 is first attached, in the conventional manner, around the boughs of a tree which has been compacted and in position with its tree trunk 21 to the left of second opening 13. As the tree, not shown, is pulled using cranking mechanism 40 as previously described the tree moves the netting off enclosure 11 and around the compacted tree boughs and holds the tree boughs in a compacted state. The netting is cut off as the tree tip passes out of cylindrical enclosure 11 and second opening 13 completing the baling process.

The present invention also provides for the use of a known method of baling referred to as spiral twining which is illustrated in FIGS. 1 and 2 using a hand wheel assembly 50 having four rollers 52 which are rotatably supported on roller shafts, not shown. The roller shafts are attached to four mounting brackets 54 which are fastened to hand wheel 51 using bolts.

FIGS. 1 and 2 describes the four rollers 52 which may be composed of a suitable plastic material, preferably polyolefin, and track partially within a molded groove 14 which is preferably integrally formed as part of the molded plastic enclosure 11 near second opening 13. Molded circumferential groove 14 which is externally formed within enclosure 11 has the benefit of not accumulating debris such as dead needles, twigs and other particles which would collect and interfere with the free rotation of rollers 52 if the groove were internally formed.

Cylindrical enclosure 11 with its integrally molded external groove 14 may be made using polyethylene plastic or other suitable plastic materials using a technique known as blow molding and is the same technique used to produce the lower portion of many 55 gallon closed head drums.

The roller shafts can be made using steel bolts, preferably shoulder screws, having an unthreaded section to support the bearings of rollers 52 for rotation.

When the hand wheel assembly 50, shown in FIG. 5, is manually turned it rotates around the central axis of enclosure 11 and carries twine spool 57 or other suitable twine holder containing sufficient twine to bale at least one tree. Twine spool 57 is supported for rotation on a twine spool shaft 58 which is attached by spool bracket 59 to hand wheel 51. A stainless steel compression spring, not illustrated, which is compressed between twine spool 57 and spool bracket 59 on the twine spool shaft, prevents free spooling of twine spool 55 and provides tension to the twine when wrapping around tree 20.

The twine spool h can be made using a steel bolt, preferably a shoulder screw. Mounting bracket 54 and spool bracket 59 may also be made using various materials such as steel or aluminum.

FIG. 5 illustrates the position of a tree within enclosure 11 ready to be baled. The free end of the twine, not shown, which is wound on twine spool 57, is attached to a limb 22 on Christmas tree 20 near its base. As the tree is advanced the hand wheel assembly 50 is turned and twine from twine spool 57 winds around the tree and spiral wraps the tree. After the tree is sufficiently advanced and wrapped the second end of the twine, not shown, may be secured by knotting it to the tree. The remainder of the tree may be manually pulled downward and out of enclosure 11 passing below crankshaft 42 completing the baling process. Attaching the rope higher on the trees main stem makes it possible to advance the base of the tree and limbs 22 under and past cranking shaft 42 by manually urging the tree downward while cranking. This procedure makes it possible to mechanically advance and spiral twine a larger section of the tree without increasing the distance between hand wheel assembly 50 and crankshaft 42 and reduces the overall length of the cart assembly.

When a Christmas tree 20 is partially baled sing netting or twine immediately following its placement into enclosure 11 the baled portion of the tree aids in supporting and securing the tree in a compacted state. When the present invention is used in this manner the length of the cylindrical portion of enclosure 11 may be further reduced to a small fraction of the original designed length due to the additional support and securing provided by the partial baling. This would be especially true if enclosure 11 were comprised having a rounded or cone shaped section at first opening 12. The completion of the baling process can take place after transporting the tree and coinciding with the removal of the tree. In addition a multi-sided enclosure which is substantially cylindrical, may be substituted for any said cylindrical enclosure.

FIG. 3 describes an alternate embodiment of the present invention not having any mechanical pulling mechanism such as hand cranking mechanism 40 which is shown in FIGS. 1 and 2 and does not have any means to bale a tree; however, all other features are identical including handle 45 and framing members 44. A tree may be compacted and transported in a compacted state using the embodiment described in FIG. 3 but this must be done manually as previously described.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described herein above are further intended to explain best modes known of practicing the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

While there have been shown and described what are at present the preferred embodiments of the invention, it will be obvious to those skilled in the art that various changes and modifications may be made therein without departing from the scope of the invention as defined by the appended claims.

I claim:

1. A cart for carrying cut trees comprising:

means for compressing the limbs of a cut tree toward the trunk of said tree and for retaining a partially compressed tree within said compressing means during the manual transport thereof;

means attached to said compressing means for manually transporting said compressing means with or without a tree therein;

means for manually moving said tree axially into said compressing means and for positioning said partially compressed tree for said retaining during said transport within said compressing means;

wherein said compressing means and said transport means as a unit can be easily moved by an individual without requiring motorized power.

2. The device as described in claim 1 wherein said moving and positioning means includes manually operated means for urging said cut tree into said compressing means and positioning said cut tree for transport while retained at lease partially within said compressing means and removing said cut tree from said compressing means.

3. The device as described in claim 2 wherein:

said compressing means has attached at the output end thereof means for maintaining the limbs for said cut tree in a compressed state upon removal from said compressing means.

4. A cart for carrying limbed cut trees comprising:

enclosure means through which an inserted tree can pass for compressing said limbs toward the trunk of said tree and for retaining said limbs and said tree during the manual transport thereof;

means for manually moving said tree axially into said enclosure means and for positioning said inserted tree at a retained position within said enclosure means for the manual transport thereof;

means attached to said enclosure means for manual transport thereof including a pair of wheels which are rotatably attached to said enclosure means by framing members wherein said enclosure means and said transport means as a unit can be easily moved by an individual without requiring motorized power.

5. The device as described in claim 4 wherein:

said moving and positioning means includes pulling means attachable to said enclosure means and to said trunk for urging said cut tree into said enclosure means and positioning said cut tree for transport within said enclosure means and removing said cut tree from said enclosure means through an exit opening.

6. The device as described in claim 5 wherein framing members are attached to said pulling means and include a crankshaft, having an attached crank-handle rotatably supported by said framing members and having a flexible elongated member.

7. The device as described in claim 5 further including:

means at said exit opening of said enclosure means for applying restraining material about said tree during exit from said enclosure means to confine said limbs to their compressed state wherein said means for applying restraining material includes a rotatable twine carrier encircling said tree.

8. The device as described in claim 5 further including:

means at said exit opening of said enclosure means for applying restraining material about said tree during exit from said enclosure means to confine said limbs to their compressed state wherein said means for applying restraining material includes a sleeve of netting encircling said tree.

9. The device as described in claim 4 wherein means attached to said enclosure means for manual transport thereof includes a handle.

* * * * *